US006066610A

United States Patent [19]

Sramek

[11] Patent Number: 6,066,610

[45] **Date of Patent: *May 23, 2000**

[54] LOW PH AMPHOTERIC FABRIC CLEANING SOLUTION

[75] Inventor: John A. Sramek, Racine, Wis.

[73] Assignee: S. C. Johnson & Son, Inc., Racine, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/934,369

[22] Filed: Sep. 19, 1997

[51] Int. Cl.[7] ..... C11D 1/88; B08B 3/04

[52] U.S. Cl. ..... 510/284; 510/283; 510/281; 510/321; 510/276; 510/306; 134/42

[58] Field of Search ..... 510/321, 340, 510/276, 506, 306; 8/137, 510, 134

[56] References Cited

U.S. PATENT DOCUMENTS

| | | | |
|---|---|---|---|
| H1513 | 1/1996 | Murch et al. | 252/546 |
| 3,844,952 | 10/1974 | Booth | 252/8.75 |
| 4,438,009 | 3/1984 | Brusky et al. . | |
| 4,595,527 | 6/1986 | Gipp . | |
| 4,749,516 | 6/1988 | Brusky . | |
| 4,842,769 | 6/1989 | Shulman et al. | 252/8.6 |
| 5,246,621 | 9/1993 | Favre et al. | 252/186.33 |
| 5,288,420 | 2/1994 | Mandy . | |
| 5,641,739 | 6/1997 | Kott et al. | 510/372 |
| 5,698,041 | 12/1997 | Woo et al. | 134/3 |

OTHER PUBLICATIONS 5 pages of a Genencor brochure entitled AFP 2000, admitted prior art.

*Primary Examiner*—Yogendra N. Gupta
*Assistant Examiner*—Gregory E. Webb

[57] ABSTRACT

Disclosed herein are fabric cleaning solutions such as clothing pre-spotters. The solutions have a mildly acidic pH and contain an amphoteric surfactant. They can be used many hours, or even a few days, before laundering in standard base detergent conditions. The solutions provide the equivalent of a "bucketless soak."

8 Claims, No Drawings

LOW PH AMPHOTERIC FABRIC CLEANING SOLUTION

CROSS-REFERENCE TO RELATED APPLICATION

Not applicable.

STATEMENT REGARDING FEDERALLY SPONSORED RESEARCH

Not applicable.

BACKGROUND OF THE INVENTION

This invention relates to surfactant solutions useable as laundry pre-spotters and for other fabric cleaning applications. More particularly, it relates to pre-spotters that can be placed on fabric many hours and/or a few days before laundering.

Laundry detergents alone are often deficient in cleaning stains due to grass, blood, oil, greases, and certain other organic sources. Various compositions have therefore been developed as "pre-spotters". See e.g. U.S. Pat. Nos. 4,438,009; 4,595,527; 4,749,516; and 5,288,420. The disclosure of these patents (and of all other publications described herein) are incorporated by reference as if fully set forth herein.

Pre-spotters are usually applied directly to difficult stains shortly before the normal washing process. However, those pre-spotters which are the most effective against stains can sometimes also lift the dye from cloth so as to create an undesirable faded area. A more serious complication is that pre-spotters are often not very effective if the fabric is not laundered relatively promptly after using the pre-spotter.

It can thus be seen that there is a need for an improved fabric cleaning solution.

BRIEF SUMMARY OF THE INVENTION

In one aspect the invention provides a fabric cleaning solution having at least 0.1% by weight of an amphoteric surfactant, at least 20% by weight of water, and a sufficient amount of an acid to cause the pH of the solution to be between 2.75 and 5.5. In a preferred form the acid is an organic acid such as citric acid, lactic acid or acetic acid, and the amphoteric surfactant is selected from the group consisting of $C_{8-22}$ amino carboxylates, aminopropionates, glycinates, phostaines, betaines, sultaines, sulfobetaines, and imidazolines.

Especially preferred amphoterics are those that carry a positive charge in acid conditions, and a negative charge in base conditions, such as Rewoteric AM KSF-40 (Witco), Miranol C2M (Rhone-Poulenc), tallow diglycerine, amine diacetate, or Ampholak 7TX (Berol). Other preferred amphoterics are sodium cocoimino proprionate, sodium laurimino proprionate, and sodium N-lauryl imino dipropionic acid.

The cleaning solution preferably contains at least 20%, preferably at least 50%, most preferably upwards of 90%, water. This is because most food and beverage stains have some water solubility.

Non-water solvents may be included and, when used, are preferably in the 0.5% to 10% weight percent range. Such solvents can be glycol ethers, glycols, hydrocarbons, and alcohols. Preferred glycol ethers are those having 2–15 carbons, such as hexylcarbitol and dipropyl glycol methyl ether. Preferred glycols are those having 2–10 carbons, such as ethylene glycol, propylene glycol, butylene glycol, dipropylene glycol and hexylene glycol. Preferred hydrocarbons are those having 10–20 carbons, such as tetradecene. Preferred alcohols are those having 2–15 carbons such as ethanol and decanol.

It is preferred that the solution have a pH of between 3 and 5.5 and contain a fungal protease that is active in that range. Fungal proteases that will readily hydrolyze organic proteins at low pH include Genencor's AFP 2000 or 1000 (CAS No. 9025-49-4). Another suitable fungal protease is NOVO Protease Complex (CAS No. 9001-61-0 Aminopeptidase).

The fabric can be selected from the group consisting of clothing, carpeting, drapery and upholstery.

Other additives which are common to liquid laundry pre-spotters can also be used such as a bacteriocide preservative (such as Kathon CG-ICP from Rohm & Haas), nonionic surfactants, and fragrances. Among the nonionic surfactants suitable for use with the present invention are ethoxylated long chain (e.g. $C_6$–$C_{22}$) alcohols; propoxylated/ethoxylated long chain alcohols such as polytergents from Olin Corp. and Plurafac from BASF Corp.; ethoxylated nonylphenols, such as the Surfonic N Series available from Huntsman Corp.; ethoxylated octylphenols, including the Triton X Series available from Rohm & Haas; ethoxylated secondary alcohols, such as the Tergitol Series available from Union Carbide; and ethylene oxide propylene oxide block copolymers, such as the Pluronics available from B.A.S.F. Most preferably ethoxylated primary alcohols known as Neodols (available from Shell Chemical) can be used. Best results have been achieved with Neodol 23-4.1 and Neodol 25-7.

Soil release polymers can also be included in the solution, such as ethoxylated polyesters (e.g. Sokalan HP-22- available from BASF and ALCO Alcosperse 745). Other soil release polymers are available from Rhone-Poulenc under the names Repel-O-Tex QCF, QCL, QCS, QCX and SRP. They are water dispersable/water solubile nonionic polyester condensation polymers of polyethylene oxide and dicarboxy anhydrides.

In another aspect, the invention provides a method of cleaning a stain from the surface of a clothing item. One applies an effective amount of the above solution to a stain on the fabric surface. Thereafter, one waits at least two hours (preferably at least overnight) before laundering the article, and then launders the article in a solution at a pH above 7. The article is preferably an item of clothing.

A wide variety of stains can be cleaned using the methods of the present invention. These include, without limitation, those caused by foods, beverages, plants (e.g. grass), motor oil and soil/dirt stains. Other organic and inorganic stains are also intended to be encompassed within the word "stain".

The invention is suitable for use on fabrics of natural fiber (e.g. cotton), those made from synthetics (e.g. polyester), and those made from blends of natural and synthetic fibers (e.g. cotton/polyester 35%/65%). Further, the invention is suitable for use on colored fabrics as well as white fabrics.

One can also add to a pre-spotter solution about 1% of hydrogen peroxide. While hydrogen peroxide is suitable for use with white cloth and certain colored fabrics, care must be taken when using it with certain other colored fabrics given its tendency to bleach.

It has surprisingly been learned that under mildly acidic conditions amphoteric surfactants act to bind up many organic stains, thus interfering with their further setting. Under base conditions (such as would be found in a solution of a typical laundry detergent), the amphoterics then help solubilize the stain (and thus help remove the stain).

As a result, the surfactant solution can be applied hours, and if desired even days, before laundering the clothes. A person who has stained their clothing need not immediately run a load of laundry. This is especially important for travelers or apartment dwellers who may not have immediate access to a washing machine.

A primary object of the invention is therefore to provide a fabric cleaning solution that can be used as a pre-spotter a substantial time before the fabric is laundered.

Another object is to provide a laundry pre-spotter which acts as a "bucketless soak".

Another object is to provide a cleaning solution that can alternatively be used as a conventional pre-spotter that is applied just before washing.

Another object is to provide solutions of the above kind that are safe to use on a wide variety of fabrics, are inexpensive, and are effective on a wide variety of common stains.

Yet another object of the present invention is to provide methods for using such cleaning solutions.

Still other objects and advantage of the present invention will become apparent from examination of the specification and claims which follow.

DETAILED DESCRIPTION OF THE INVENTION

Examples of fabric cleaning solutions useful with the present invention are:

| Weight percent | Common or commercial name | Description |
|---|---|---|
| Example I | | |
| 1.00 | Sokalan HP-22 | nonionic soil release polymer |
| 2.00 | Neodol 23-4.1 | nonionic surfactant |
| 7.00 | Neodol 25-7 | nonionic surfactant |
| 6.00 | Deriphat 151-C | coco amino propionate - amphoteric surfactant |
| 1.00 | Neodene 14 | tetradecene |
| 0.56 | 50% citric acid/ 50% water | acid |
| 0.10 | fragrance | fragrance |
| 1.00 | Genencor AFP 1000A | fungal hydrolyzing protease |
| 0.3 | Kathon CG-ICP | preservative |
| balance | water | water |
| Example II | | |
| 1.00 | Sokalan HP-22 | nonionic soil release polymer |
| 7.00 | Neodol 23-4.1 | nonionic surfactant |
| 4.00 | Rewoteric AM KSF-40 | amphoteric surfactant |
| 1.72 | 50% citric acid/ 50% water | acid |
| 0.10 | fragrance | fragrance |
| 1.00 | Genencor AFP 1000A | fungal hydrolyzing protease |
| 0.03 | Kathon CG-ICP | preservative |
| balance | water | water |

The above solutions can be prepared by starting with water and mixing in the other components in the order listed at room temperature.

My laboratory has also prepared and tested numerous other formulations. For example, I have varied the pH of the formulations, varied nonionic levels, varied polymer levels, and varied organic solvent levels. From these experiments, I have determined that the amphoteric nature of the surfactant is the most critical feature of the invention.

To test the effectiveness of these solutions, I stained a variety of white and blue cotton and cotton/polyester blend swatches with various stains that are commonly encountered. These included motor oil, lard, grape juice, spaghetti with meat sauce, sebum, dirt, and grass. I let the stain set overnight before treatment with the cleaning solution.

Typically I then treated the stain by dropping onto it about 2 cc of the solution or a control. I then rubbed the solution into the stain. After that, I let the pre-spotter treated fabric sit overnight (albeit in some cases only for five minutes for comparison).

A standard protocol for washing the stain was used (e.g. about 16 gallons of water, a 90 degree F. wash and a 60 degree F. rinse). I typically used 42 grams of Tide Ultra 2 detergent for the test (a high pH detergent). I then dried the swatches in a dryer, in a conventional manner.

Using a Hunter Lab photoelectric colorimeter I then compared the stained/treated swatches to controls. I also visually inspected the swatches.

For most stains, the amphoteric pre-spotter surprisingly worked better after an overnight wait before laundering (albeit for some stains it also worked well without the wait). In the overnight tests the pre-spotter was effective against many types of stains.

It should therefore be appreciated that the present invention is tantamount to a "bucketless soak" system. It avoids the need for promptly running a laundry load after a stain occurs, or promptly after the pre-spotter is used.

What has been described above are the preferred embodiments of the present invention. Other embodiments are also within the intended scope of the claims. For example, the solution can be applied by a variety of techniques such as spraying, squirting, and/or pouring (usually followed by rubbing). As such, the claims which follow should be looked to in order to judge the full scope of the invention.

Industrial Applicability

The invention provides fabric cleaning solutions useful in cleaning stained clothing and other fabrics.

I claim:

1. A method for removal of a stain from a colored fabric, comprising the steps of:

applying to said stain an effective amount of an aqueous solution comprising at least 0.1% by weight of an amphoteric surfactant, at least 20% by weight of water, and sufficient acid to cause the pH of the solution to be between 2.75 and 5.5;

allowing said aqueous solution to remain on said stain for at least two hours in a manner so as not to bleach the fabric color; and then laundering the fabric at a pH greater than pH 7.0.

2. The method as set forth in claim 1, wherein said fabric comprises fibers selected from the group consisting of natural fibers, synthetic fibers, and mixtures thereof.

3. The method as set forth in claim 2, wherein said fabric is selected from the group consisting of clothing, carpeting, drapery, and upholstery.

4. The method as set forth in claim 1, wherein said acid is selected from the group consisting of citric acid, lactic acid, and acetic acid.

5. The method as set forth in claim 4, wherein said amphoteric surfactant is selected from the group consisting of $C_{8-22}$ amino carboxylates, aminopropionates, glycinates, phostaines, betaines, sultaines, sulfobetaines, and imidazolines.

6. The method as set forth in claim 5, wherein said solution further comprises a fungal protease.

7. The method as set forth in claim 1, wherein said solution further comprises a solvent selected from the group consisting of glycols, alcohols, glycol ethers, and hydrocarbons.

8. The method as set forth in claim 7, wherein said solution further comprises at least one additive selected from the group consisting of bacteriocide preservatives, nonionic surfactants, fragrances, and soil release polymers.

* * * * *